US009844814B2

(12) United States Patent
Jonker et al.

(10) Patent No.: US 9,844,814 B2
(45) Date of Patent: Dec. 19, 2017

(54) SUPERHARD TOOL TIP, METHOD FOR MAKING SAME AND TOOL COMPRISING SAME

(75) Inventors: Cornelis Roelof Jonker, Springs (ZA); Robert Fries, Springs (ZA); Maweja Kasonde, Springs (ZA); John James Barry, County Clare (IE)

(73) Assignees: Element Six Abrasives S.A., Luxembourg (LU); Element Six Limited, County Clare (IE)

( * ) Notice: Subject to any disclaimer, the term of this patent is extended or adjusted under 35 U.S.C. 154(b) by 756 days.

(21) Appl. No.: 13/576,049

(22) PCT Filed: Feb. 11, 2011

(86) PCT No.: PCT/EP2011/052034
§ 371 (c)(1),
(2), (4) Date: Oct. 16, 2012

(87) PCT Pub. No.: WO2011/098559
PCT Pub. Date: Aug. 18, 2011

(65) Prior Publication Data

US 2013/0047397 A1 Feb. 28, 2013

(30) Foreign Application Priority Data

Feb. 12, 2010 (GB) ..... 1002375.2

(51) Int. Cl.
*B23B 27/14* (2006.01)
*B22F 7/06* (2006.01)
(Continued)

(52) U.S. Cl.
CPC ..... *B22F 7/06* (2013.01); *B22F 7/08* (2013.01); *C22C 26/00* (2013.01);
(Continued)

(58) Field of Classification Search
CPC ..... B22F 7/06; B22F 7/08; B22F 2005/001; C22C 26/00; Y10T 29/49801;
(Continued)

(56) References Cited

U.S. PATENT DOCUMENTS 4,527,643 A 7/1985 Horton et al.
4,604,106 A 8/1986 Hall et al.
(Continued)

FOREIGN PATENT DOCUMENTS

EP 0528243 A2 2/1993
JP 58079879 A2 11/1981
(Continued)

*Primary Examiner* — Sunil K Singh
*Assistant Examiner* — Paul M Janeski
(74) *Attorney, Agent, or Firm* — Armstrong Teasdale LLP

(57) ABSTRACT

A tip (20) for a rotary machine tool comprising a superhard structure (12) joined to a cemented carbide substrate 14 by means of at least one intermediate layer (161, 62, 163) disposed between the superhard structure (12) and the cemented carbide substrate (14), the intermediate layer or layers (161, 162, 163) comprising grains of superhard material and grains of a metal carbide material dispersed in a metal binder material.

16 Claims, 8 Drawing Sheets

(51) Int. Cl.
*B22F 7/08* (2006.01)
*C22C 26/00* (2006.01)
*B22F 5/00* (2006.01)

(52) U.S. Cl.
CPC ... *B22F 2005/001* (2013.01); *Y10T 29/49801* (2015.01); *Y10T 407/1904* (2015.01); *Y10T 408/78* (2015.01); *Y10T 428/12028* (2015.01); *Y10T 428/12146* (2015.01)

(58) Field of Classification Search
CPC ..... Y10T 407/1904; Y10T 408/78; Y10T 428/12028; Y10T 428/12146; B23B 2226/315; B23B 51/02; B23B 27/18; B23B 27/20; B23B 2222/28
See application file for complete search history.

(56) References Cited

U.S. PATENT DOCUMENTS

| | | | |
|---|---|---|---|
| 4,627,503 A | 12/1986 | Horton | |
| 4,694,918 A | 9/1987 | Hall | |
| 4,713,286 A | 12/1987 | Bunting et al. | |
| 4,744,705 A | 5/1988 | Imanaga | |
| 4,762,445 A | 8/1988 | Bunting et al. | |
| 4,861,673 A | 8/1989 | Hara et al. | |
| 4,880,707 A | 11/1989 | Kohno et al. | |
| 4,991,467 A | 2/1991 | Packer | |
| 5,031,484 A | 7/1991 | Packer | |
| 5,115,697 A | 5/1992 | Rodriguez et al. | |
| 5,370,195 A | 12/1994 | Keshavan et al. | |
| 5,580,196 A * | 12/1996 | Thompson | B23B 51/02 407/119 |
| 5,766,394 A | 6/1998 | Anderson et al. | |
| 5,868,885 A | 2/1999 | Crockett et al. | |
| 6,446,740 B2 | 9/2002 | Eyre | |
| 2005/0210755 A1 * | 9/2005 | Cho et al. | 51/293 |
| 2006/0166615 A1 * | 7/2006 | Tank | B22F 7/06 451/540 |
| 2008/0019787 A1 | 1/2008 | Sampath et al. | |

FOREIGN PATENT DOCUMENTS

| | | |
|---|---|---|
| JP | 60-264371 A | 12/1985 |
| JP | 62-041778 A | 2/1987 |
| JP | 4275805 A | 3/1991 |
| WO | 2006032984 A2 | 3/2006 |
| WO | 2006099194 A2 | 9/2006 |
| WO | 2007110770 A2 | 10/2007 |
| WO | 2011017582 A2 | 2/2011 |

* cited by examiner

SUPERHARD TOOL TIP, METHOD FOR MAKING SAME AND TOOL COMPRISING SAME

BACKGROUND

Embodiments of the invention relate generally to a superhard tip for a rotary machine tool, and more particularly, but not exclusively, for a twist drill or an end mill; to methods for making same and tools comprising same.

Examples of superhard materials are polycrystalline diamond (PCD) material and polycrystalline cubic boron nitride (PCBN) material. PCD material comprises a mass of substantially inter-grown diamond grains and PCBN material comprises cubic boron nitride (cBN) particles within a matrix comprising metal and/or ceramic material. PCD and PCBN may be made by subjecting aggregated masses of diamond grains or cBN grains, respectively, to an ultra-high pressure of at least about 5.5 GPa and temperature of at least about 1,250 degrees centigrade.

U.S. Pat. No. 4,762,445 discloses a composite sintered twist drill that is particularly suited for helically fluted twist drills larger than approximately 3.17 mm in diameter. The hardest material, which may comprise diamond, is located in narrow veins at the leading edges and across the mid line of the drill tip.

There is a need to provide an alternative superhard tip for a rotary machine tool.

SUMMARY

Viewed from a first aspect, there can be provided a superhard tip (or simply "tip") for a rotary machine tool, for example a twist drill or end mill, comprising a superhard structure joined to a cemented carbide substrate by means of at least one intermediate layer disposed between the superhard structure and the cemented carbide substrate, the intermediate layer comprising grains of superhard material, such as synthetic or natural diamond, or cubic boron nitride (cBN), and grains of a metal carbide material dispersed in a metal binder material.

Viewed from a second aspect, there can be provided a blank body (also referred to as superhard blank body) for a tip (or "superhard tip") for a rotary machine tool, comprising a superhard structure joined to a cemented carbide substrate by means of at least one intermediate layer disposed between the superhard structure and the cemented carbide substrate, the intermediate layer comprising grains of superhard material, such as synthetic or natural diamond, or cubic boron nitride (cBN), and grains of a metal carbide material dispersed in a metal binder material.

Viewed from a third aspect, there can be provided a rotary machine tool comprising a tip (or "superhard tip"), the tip comprising a superhard structure joined to a cemented carbide substrate by means of an intermediate layer disposed between the superhard structure and the cemented carbide substrate, the intermediate layer comprising grains of superhard material, such as synthetic or natural diamond, or cubic boron nitride (cBN), and grains of a metal carbide material dispersed in a metal binder material.

Viewed from a fourth aspect, there can be provided a method of making a tip as claimed in any one of the preceding claims, the method including providing a blank body comprising a superhard structure joined to a cemented carbide substrate by means of an intermediate layer disposed between the superhard structure and the cemented carbide substrate, the intermediate layer comprising grains of superhard material and grains of a metal carbide material; and removing material from the blank body to form cutting edges.

Viewed from a fifth aspect, there can be provided a method of machining a body, particularly but not exclusively by drilling or milling, the body comprising titanium (Ti), carbon fibre-reinforced polymer (CFRP) material, or both Ti and CFRP material, using a rotary machine tool comprising a tip (or "superhard"), the tip comprising a PCD structure joined to a cemented carbide substrate by means of an intermediate layer disposed between the superhard structure and the cemented carbide substrate, the intermediate layer comprising grains of superhard material, such as synthetic or natural diamond, or cubic boron nitride (cBN), and grains of a metal carbide material dispersed in a metal binder material.

Viewed from a sixth aspect, there can be provided a tip for an ball-nose end mill for machining a body, the body particularly but not exclusively comprising cast iron, grey and high strength irons, hardened tool steel or a superalloy material such as a Cr—Ni superalloy material, the tip comprising a PCBN structure joined to a cemented carbide substrate by means of an intermediate layer disposed between the superhard structure and the cemented carbide substrate, the intermediate layer comprising grains of superhard material, such as synthetic or natural diamond, or cubic boron nitride (cBN), and grains of a metal carbide material dispersed in a metal binder material.

BRIEF INTRODUCTION TO THE DRAWINGS

Non-limiting arrangements of tips, blank bodies for tips and tools will now be described with reference to the accompanying drawings, of which, FIG. 1 shows a schematic perspective view of an example blank body.

FIG. 8B shows a schematic top view of the twist drill illustrated in FIG. 8A, viewed end-on.

Figure 1:
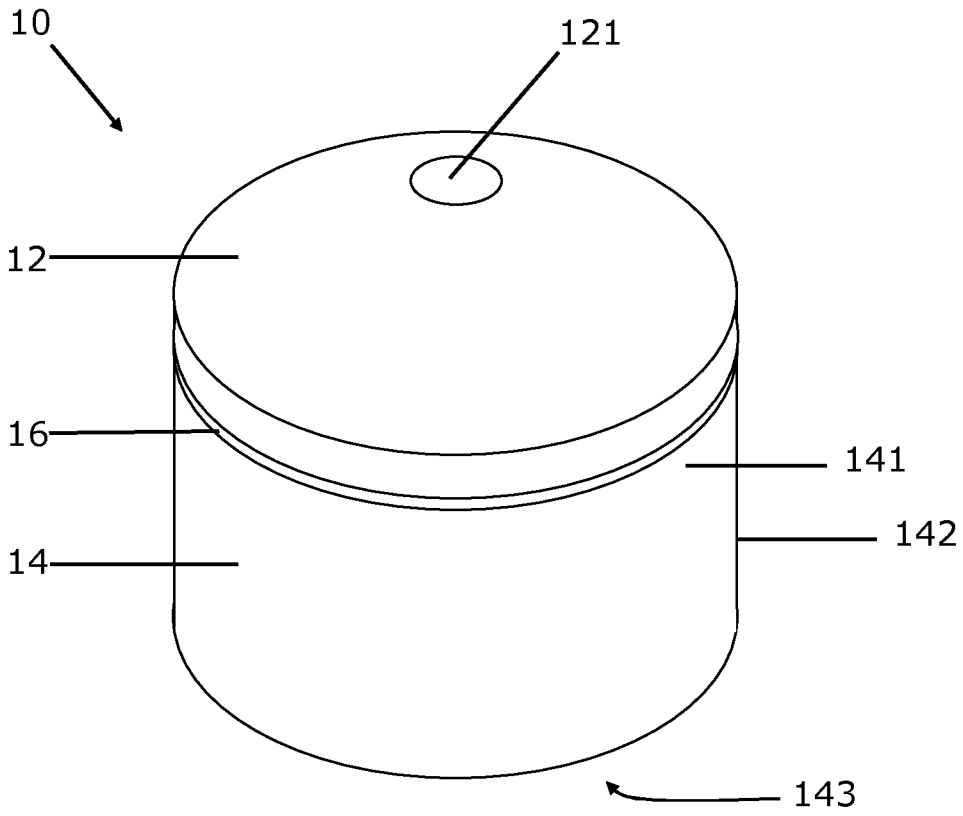

The same references refer to the same general features in all of the drawings.

DETAILED DESCRIPTION

Certain terms as used herein are briefly explained below.

As used herein, "superhard" or ultra-hard material has Vickers hardness of at least 25 GPa. Synthetic and natural diamond, polycrystalline diamond (PCD), cubic boron nitride (cBN) and polycrystalline cBN (PCBN) material are examples of superhard materials. Synthetic diamond, which is also called man-made diamond, is diamond material that has been manufactured. A polycrystalline superhard structure comprises a sintered mass of superhard grains, a substantial fraction of which may be directly, or coherently, bonded to neighbouring grains. A PCD structure comprises or consists essentially of PCD material and a PCBN structure comprises or consists essentially of PCBN material.

Polycrystalline diamond (PCD) material comprises a mass (an aggregation of a plurality) of diamond grains, a substantial portion of which are directly inter-bonded with each other and in which the content of diamond is at least about 80 volume percent of the material. Interstices between the diamond grains may be at least partly filled with a binder material comprising catalyst material for synthetic diamond, or they may be substantially empty. A catalyst material for synthetic diamond is capable of promoting the growth of synthetic diamond grains and or the direct inter-growth of synthetic or natural diamond grains at a temperature and pressure at which synthetic or natural diamond is thermodynamically stable. Examples of catalyst materials for diamond are Fe, Ni, Co and Mn, and certain alloys including these. Superhard structures comprising PCD material may comprise at least a region from which catalyst material has been removed from the interstices, leaving interstitial voids between the diamond grains. PCD structures having at least a significant region from which catalyst material for diamond has been depleted, or in which catalyst material is in a form that is relatively less active as a catalyst, may be described as thermally stable PCD.

PCBN material comprises grains of cubic boron nitride (cBN) dispersed within a matrix comprising metal or ceramic material. For example, PCBN material may comprise at least about 60 volume percent cBN grains dispersed in a binder matrix material comprising a Ti-containing compound, such as titanium carbonitride and/or an Al-containing compound, such as aluminium nitride, and/or compounds containing metal such as Co and/or W. Some versions (or "grades") of PCBN material may comprise at least about 80 volume percent or even at least about 85 volume percent cBN grains.

A machine tool is a powered mechanical device, which may be used to manufacture components comprising materials such as metal, composite material, wood or polymers by machining. Machining is the selective removal of material from a body, which may be called a workpiece. A rotary machine tool comprises a cutter element, for example a drill bit, which rotates about its own axis in use. A tipped tool or insert is one in which the cutting edge is formed by a cutter tip comprised of a different material from that of the rest of the tool or insert, the tip typically being brazed or clamped onto a tool body. A tip for a machine tool may be produced by processing a blank body to form it into a configuration for a tip. A rake face of a machine tool is the surface or surfaces over which chips flow when the tool is used to remove material from a body, the rake face directing the flow of newly formed chips. Chips are the pieces of a workpiece removed from a work surface of the workpiece by a machine tool in use. A cutting edge of a tip is the edge of a rake face intended to perform cutting of a body.

A twist drill is a fluted tipped drill for drilling holes into workpieces, particularly workpieces comprising metals, wood and plastics, by means of a rotational shear cutting action. A twist drill can be described generally as a rotary end cutting tool having one or more cutting faces or lips, and also one or more helical or straight flutes for conveying the chip from a hole being drilled. A "flute" is a recessed portion of a rotary machine tool for conveying chips away from a cutting edge as the tool rotates in use. Other rotary machine tools, such as taps, ball-nose end mills and straight end mills (also referred to as slot-drills) may have up to six or more cutting edges and flutes. Flutes may have the form of grooves that appear generally semi-circular in cross section. While some drills contain straight flutes, extending parallel to the axis of the tool, most twist drills comprise helical flutes configured subject to design considerations such as the desired rake angle of the cutting edge, the ease of chip evacuation and the stiffness of the drill.

A twist drill may comprise two or more flutes, one for each cutting edge at a working end of the drill. Cutting edges may act to shear the work material into more easily removable chips and may be comprised in the point of the drill, which may also comprise a chisel edge located between the cutting edges. In the simplest drills, the chisel edge geometry may be determined by the thickness of the web, which is the portion of material that separates the flutes. As the web portion of a drill does not cut work material, but rather extrudes it outwardly from the centre line towards the cutting edges, its length may be minimised by forming notches at the intersection between the flutes and the drill point surface. The design of the drill point, particularly the web and notch arrangement, may influence the degree to which the drill rotates concentrically about a guiding mechanism for the axis of rotation. The "cylindrical land" of a twist drill is the peripheral portion of the body of the drill between adjacent flutes. The cylindrical land of the drill may be configured to provide clearance between the drill body and the surface of the hole being produced. It may also help guide the drill on a trajectory.

A twist drill would typically be held in a chuck, collet or other mechanical coupling device which is mounted on a precision spindle. In use, it is rotated about its own axis of rotation and may be linearly translated such that the drill advances through a workpiece, expelling the waste metal in the form of chips or swarf.

Examples of tips, blank bodies for tips and tools comprising tips will now be described with reference to FIG. 1 to FIG. 8B.

FIG. 1 shows an example of a blank body 10 for a tip for a twist drill (not shown), comprising a superhard structure 12 joined to a cemented carbide substrate 14 by means of an intermediate layer 16 disposed between the superhard structure 12 and the cemented carbide substrate 14. The intermediate layer 16 comprises grains of synthetic diamond and grains of WC dispersed in a metal binder material comprising Co.

Figure 2A:
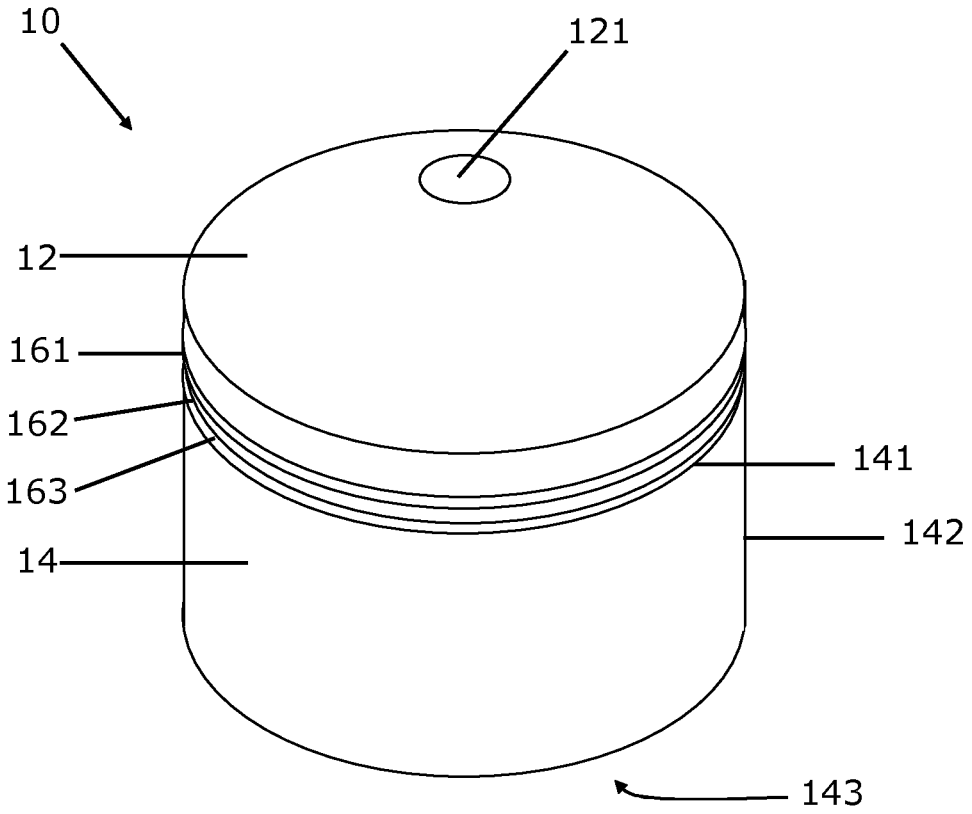
FIG. 2A shows a schematic perspective view of an example blank body.
Figure 2B:
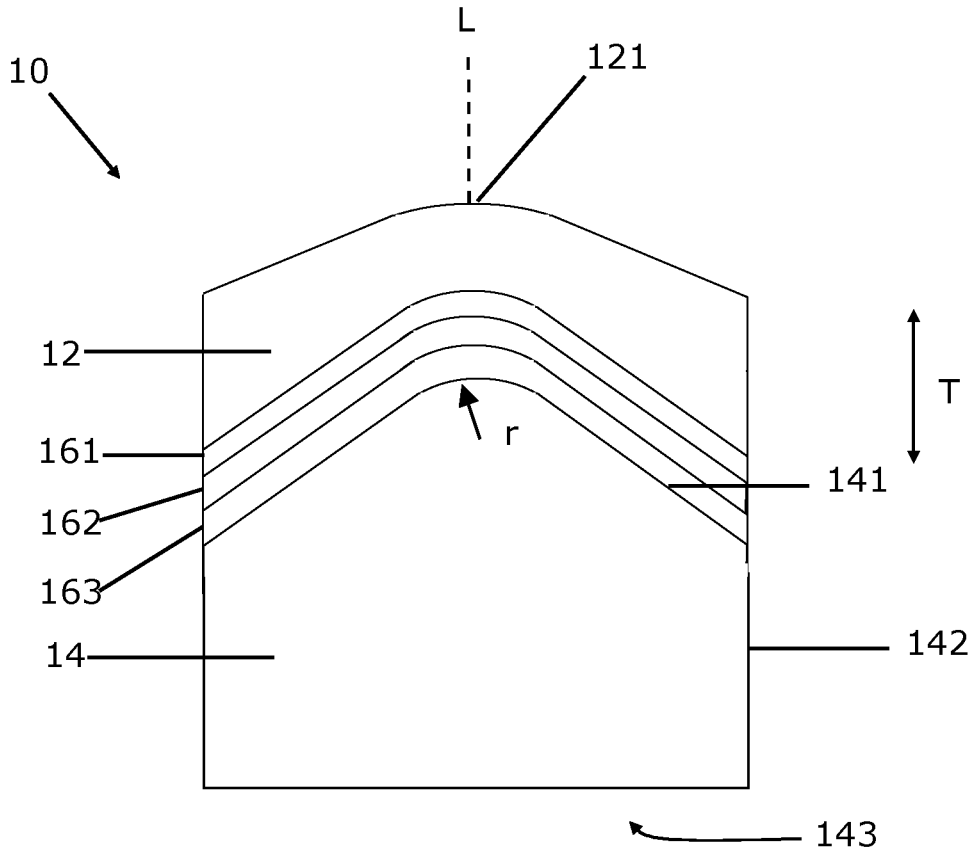
FIG. 2B shows a schematic cross section view of an example blank body.

FIG. 2A and FIG. 2B illustrate an example of a superhard blank body 10, in which the superhard structure 12 is joined to the cemented carbide substrate 14 by means of three intermediate layers 161, 162, 163 disposed between the superhard structure 12 and the cemented carbide substrate 14. Each of the three intermediate layers 161, 162, 163 comprises different respective compositions of diamond grains, metal carbide grains and metal binder. In these examples, a working end of each blank body 10 has a generally rounded cone shape having a rounded apex 121, and the cemented carbide substrate 14 has a generally cylindrical form having a proximate 141 and a distal end 143, the proximate end 141 being a working end and the distal end 143 being an attachment end, and a side surface 142 connects the proximate 141 and distal 143 ends. At least part of the working end 141 may have a substantially conical, frusto-conical shape or rounded conical shape, for example a spherically rounded conical shape. The longitudinal thickness T of the superhard structure 12 is not necessarily the same throughout the structure and in the example illustrated in FIG. 2B, the longitudinal thickness T of the superhard structure 12 is greater adjacent a cutting edge than it is at the apex.

Figure 3:
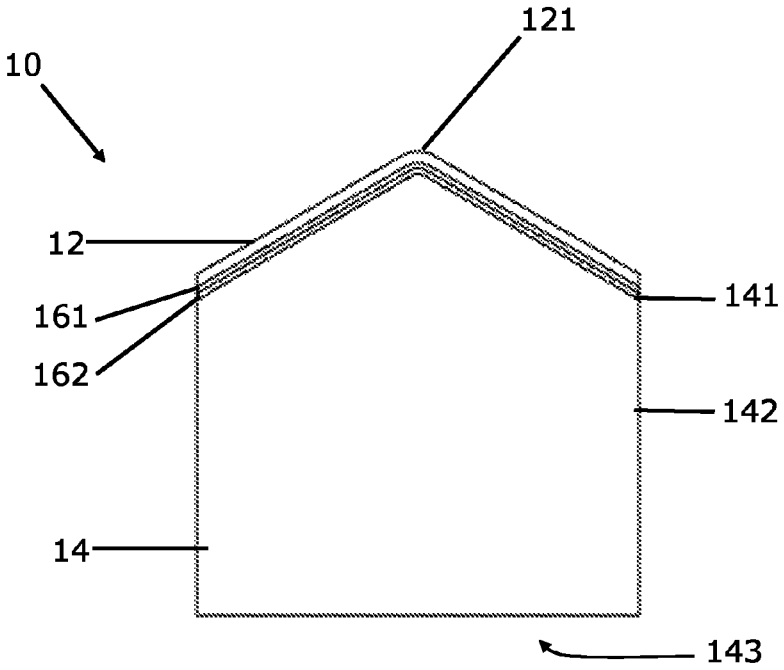
FIG. 3 shows a schematic cross section view of an example blank body.
Figure 4:
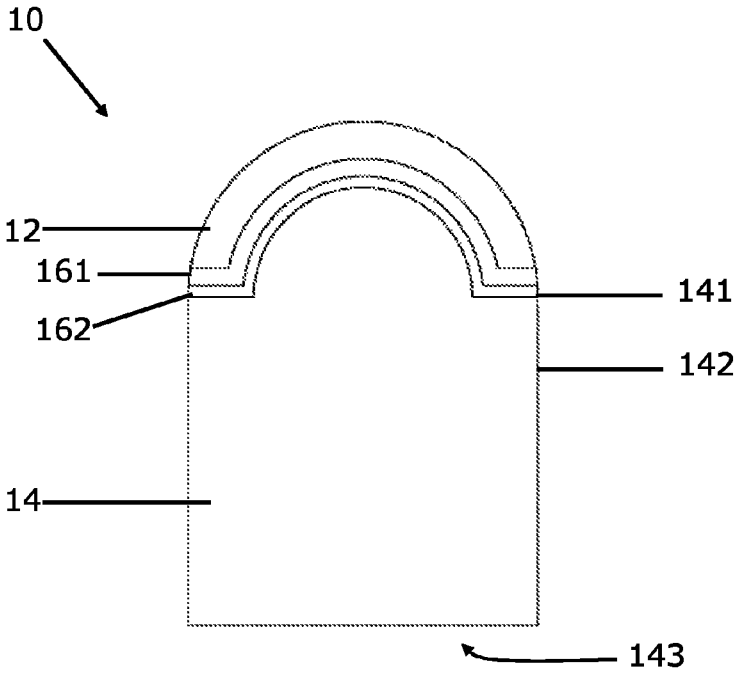
FIG. 4 shows a schematic cross section view of an example blank body.
Figure 5:
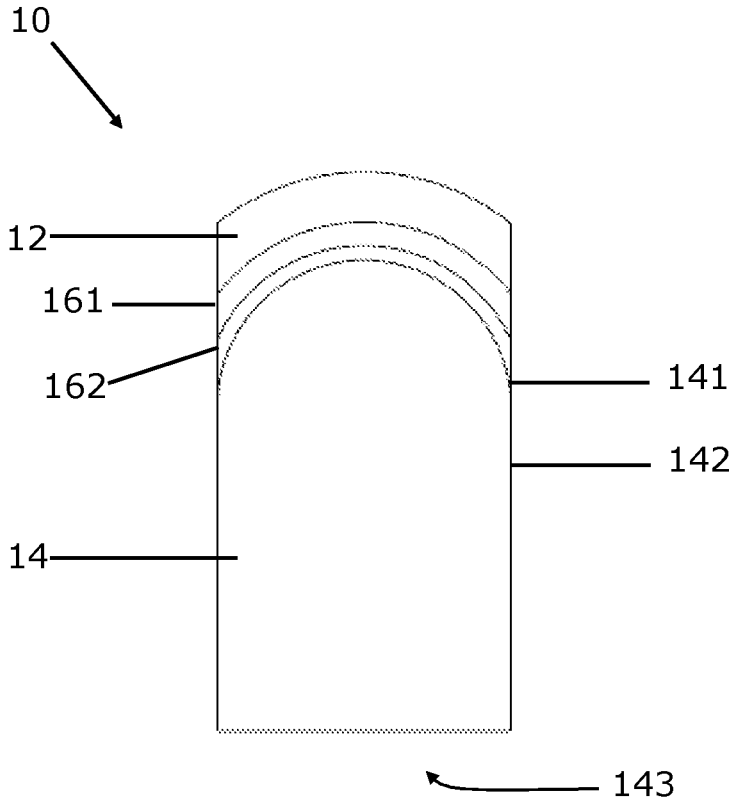
FIG. 5 shows a schematic cross section view of an example blank body.

FIG. 3, FIG. 4 and FIG. 5 illustrate further examples of blank bodies 10, in which the superhard structure 12 is joined to the cemented carbide substrate 14 by means of two intermediate layers 161 and 162, disposed between the superhard structure 12 and the cemented carbide substrate 14. Each of the three intermediate layers 161, 162, comprises different respective compositions of diamond grains, metal carbide grains and metal binder. In FIG. 3, a working end of the blank body 10 has a generally rounded (or "blunted") cone shape having a rounded apex 121. In FIG. 4, a working end of the blank body 10 has a generally domed shape and the interfaces between the superhard structures 12, the intermediate layers 161, 162 and the substrate 14 have the general form of a dome surrounded by an annular ledge. In FIG. 5, a working end of the blank body 10 has a generally domed shape and the interfaces between the superhard structure 12, the intermediate layers 161, 162 and the substrate 14 have the general outline domes.

Tips having a generally domed shape may be particularly useful for ball-nose end mills. A ball-nose end mill may be used to manufacture articles having arcuate concave features, such as extrusion moulds for injection moulding or components of constant velocity (CV) joints for automobiles. A rounded or domed tip comprising PCBN material disclosed may be useful for ball-nose end mills for machining a body comprising cast iron, grey and high strength irons, hardened tool steel or a superalloy material such as a Cr—Ni superalloy material.

Figure 6:
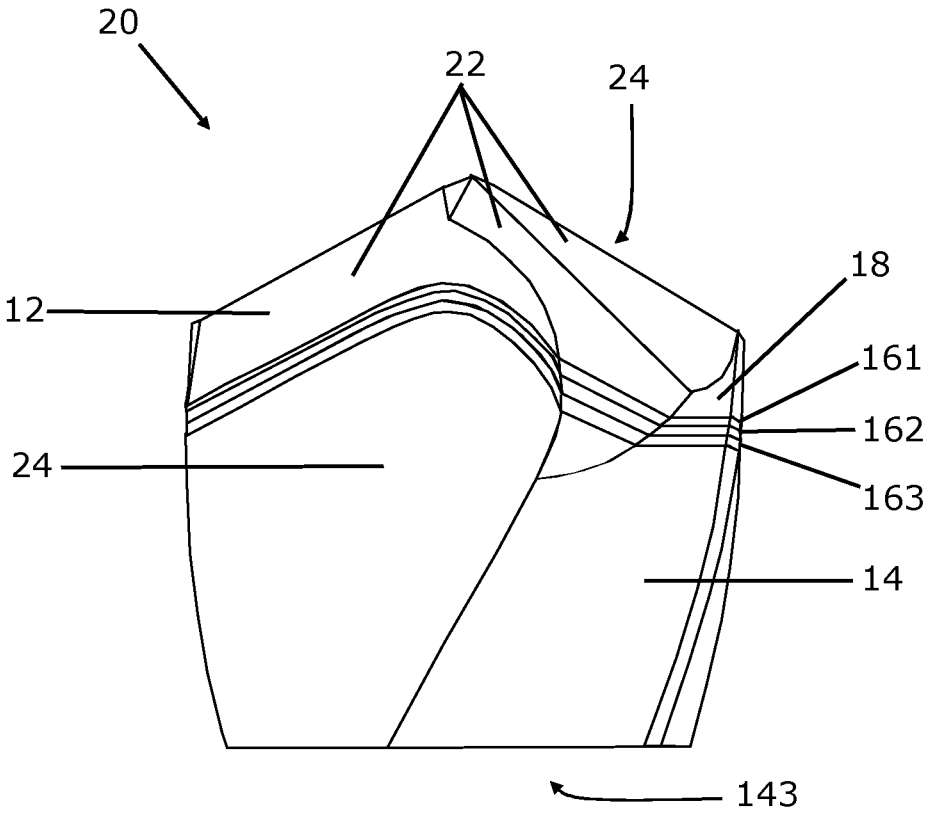
FIG. 6 shows a schematic perspective view of an example tip for a twist drill.

With reference to FIG. 6, an example of a superhard tip 20 for a twist drill bit (not shown) comprises a superhard structure 12 formed with cutter faces 22 and joined to a cemented carbide substrate 14 by means of three intermediate layers 161, 162 and 163 disposed between the superhard structure 12 and the cemented carbide substrate 14, the intermediate layers 161, 162, 163 comprising grains of a superhard material and grains of a metal carbide material dispersed in a metal binder. Flutes 24 are formed into the superhard structure 12 and the cemented carbide substrate 14. Peripheral sides of the superhard structure 12 define cylindrical lands 18 connecting the flutes 24.

Figure 7:
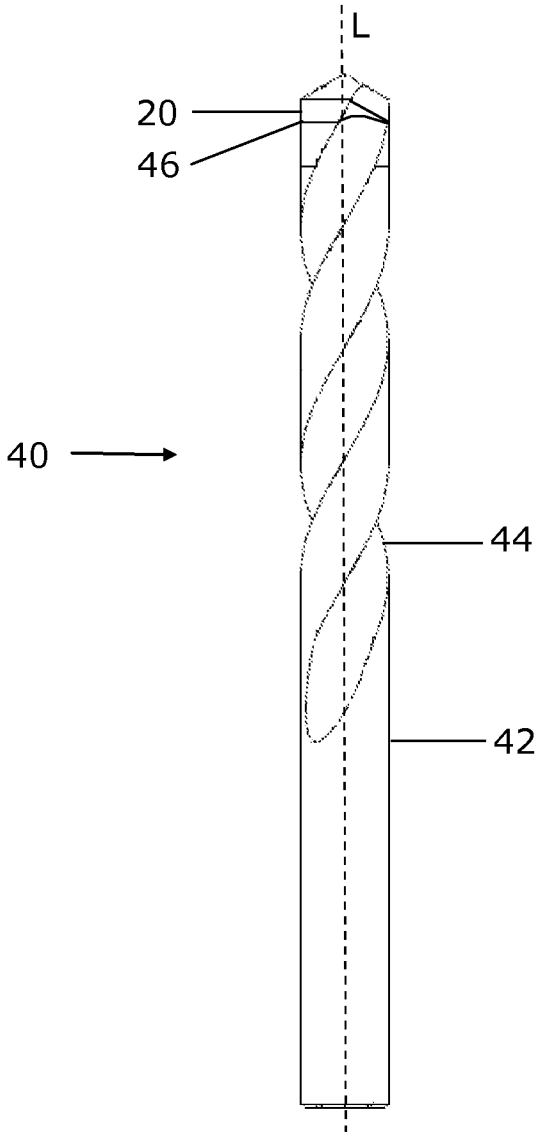
FIG. 7 shows a schematic perspective view of an example twist drill.

As illustrated by FIG. 7, an example twist drill 40 may comprise a drill shaft 42 having a flute 44, and a superhard tip 20 joined to an end 46 of the drill shaft 42. The drill shaft 42 defines a longitudinal axis L.

Figure 8A:
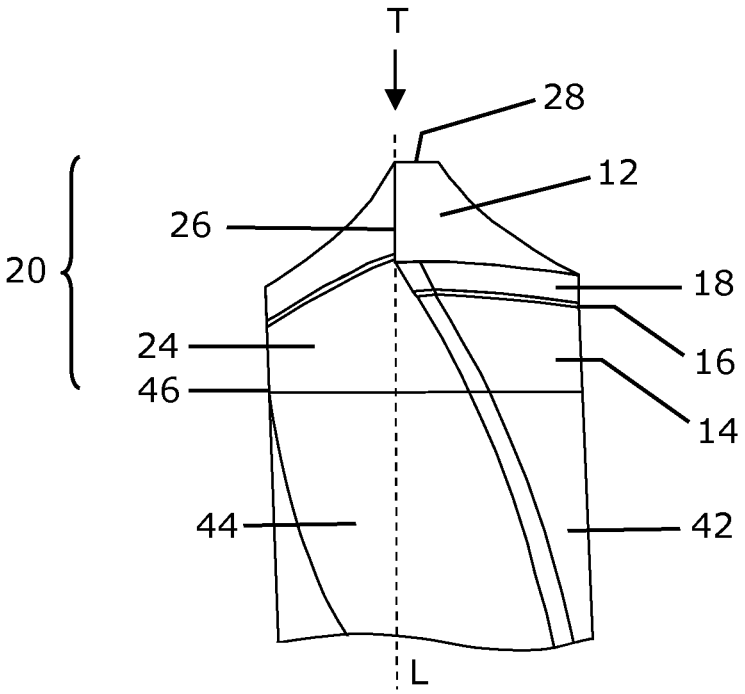
FIG. 8A shows a schematic side view of an end portion of an example twist drill.
Figure 8B:
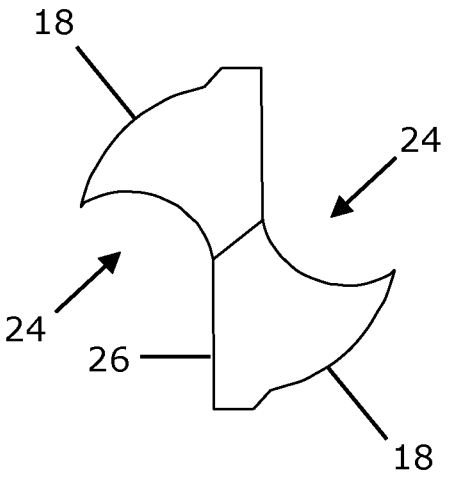

With reference to FIG. 8A and FIG. 8B, an example twist drill (only part of which is shown) comprises a drill shaft 42 comprising at least two flutes 44 (only one of which is visible in FIG. 8A) and a superhard tip 20 joined to the drill shaft at a proximate end 46 of the drill shaft 42. FIG. 8B shows an end-on, or top view of the superhard tip in the direction T indicated in FIG. 8A. The superhard tip 20 comprises two flutes 24 configured to match the flutes 44 of the shaft 42 at the end 46, and defines two cutting edges 26, each associated with a respective flute 24. In this particular example, the superhard structure 12 defines a chisel edge 28. The superhard tip 20 comprises a superhard layer 12 joined to a cemented carbide substrate 14 by means of an intermediate layer 16 disposed between the superhard structure 12 and the cemented carbide substrate 14, the intermediate layer 16 comprising grains of diamond and grains of a metal carbide material dispersed in a metal binder. Peripheral sides of the superhard structure 12 define cylindrical lands 18 connecting the flutes 24. In one version (not illustrated) of the example, at least part of the peripheral sides of the superhard structure may narrow to define a peripheral edge (or at least a relatively thin peripheral land), the peripheral edge portion and the peripheral surface portion in combination connecting adjacent flutes formed in the superhard tip.

In some example tips, the thickness of the intermediate layer or combined thickness of more than one layer may be at least about 0.1 mm, since a layer or layers substantially thinner than this may not be effective. The mean content of superhard grains in the intermediate layer or layers may be at least about 10 weight percent of the composition of the intermediate layer. The intermediate layer or layers may comprise at least about 30 volume percent and at most about 80 volume percent diamond grains; or the intermediate layer or layers may comprise at least about 10 volume percent and at most about 50 volume percent cBN grains. If the diamond content of an intermediate layer is substantially greater than about 80 volume percent, the diamond grains are likely to inter-grow, resulting in the formation of PCD material. If the mean content of diamond grains is substantially less than about 30 weight percent, the properties of the intermediate layer may not provide an effective transition from those of the superhard material to those of cemented carbide material. If the cBN content of an intermediate layer is substantially greater than about 50 volume percent or substantially less than about 10 weight percent, the properties of the intermediate layer may not provide an effective transition from those of the superhard material to those of cemented carbide material. In particular, where the superhard structure consists of PCBN material comprising less than about 80 volume percent cBN and the intermediate layer or layers comprise cBN grains, a lower content of the cBN grains may suffice than in the case where the superhard structure consists of PCD material and the superhard grains in the intermediate layer or layers are diamond grains. The gradation of properties between the superhard structure and the substrate may be enhanced if the mean content of metal binder material in the intermediate layer(s) is not substantially greater than that in the cemented carbide substrate. The intermediate layer or layers may contain both cBN grains and diamond grains.

In one example arrangement, a tip may comprise a PCD structure and at least three intermediate layers, each having a different content of diamond grains (and consequently different contents of carbide grains and metal binder material). In another example, there may be at least one intermediate layer in which the content of diamond grains changes more gradually through the layer. The diamond content in the intermediate layer or layers may increase from the interface with the cemented carbide substrate toward the interface with the superhard structure. In one arrangement, there may be a substantially continuous gradation from cemented carbide material to PCD material.

Drill tips disclosed herein may have the aspect of relative simplicity and reduced cost of manufacture as a result of reduced number of steps required. A reason for this may be that the superhard structure may be integrally formed with the substrate rather than provided pre-sintered and then attached to the substrate. The approach of providing a unitary and integrally formed superhard blank body and then processing it to form a tip for a rotary tool is likely to allow more complex point and cutting edge configurations to be provided relatively efficiently. However, a trade-off between relative simplicity of manufacture on the one hand, and robustness in use on the other might be expected.

Rotary machine tools such as drill bits having PCD tips may be used to machine bodies comprising Ti or CFRP, of combinations of Ti and CFRP. A rotary machine tool tip is likely to experience high shear stress acting against the cutting structure in use. The shear stress is likely to be more severe where the body being drilled comprises very strong material, such as Ti or CFRP, or both. In superhard drill tips in which the superhard structure defining the cutting edge is present as a vein embedded within a cemented carbide body, the mass of cemented carbide behind the superhard structure would be likely to support it and reduce the likelihood of, or even prevent the superhard structure being sheared off by the shear stress. In superhard tips in which the superhard structure is provided as a layer or cap bonded to a cemented carbide substrate, there may be a greater risk of the superhard being sheared off, or at least a part of the superhard structure breaking off and becoming detached from the substrate in use. The provision of a superhard grain-containing intermediate layer as disclosed herein may have the aspect of reducing this risk and enhancing the robustness of the tip, albeit with a relatively minor trade-off of some degree of acceptable complexity.

The drilling of hard-to-machine workpieces comprising, for example comprising Ti or CFRP or both, is likely to result in a relatively high rate of wear of the drill tip and it may be more efficient to use a tip material having as high wear resistance as possible. While PCD material in general is understood to have a high abrasive wear resistance, different grades of PCD have may have different wear resistances. Different grades of PCD may have different structural and compositional characteristics, such as different diamond content, different size distributions of diamond grains and different content of catalyst material within interstices between diamond grains. In general, it would be expected that the abrasive wear resistance would be greater for higher content of diamond and consequently lower content of catalyst material, such as cobalt. Unfortunately, such grades are expected to be more vulnerable to de-lamination from a cemented carbide substrate.

Drill bits may be reconditioned from time to time in order to extend their working life. This may be done by grinding the tip, which would require the removal of some material from the tip. Commercially viable PCD-tipped drill bits may need to be re-ground three to four times, with the about 0.5 mm being removed form the surface each time. Where the PCD structure has the general form of a layer joined to a cemented carbide substrate, it may therefore need to be at least about 2.5 mm or at least about 3 mm thick. Such a relatively thick layer of PCD would be expected to increase the risk of de-lamination, likely owing to the difference in thermal properties such as coefficient of thermal expansion (CTE) between PCD material and cemented carbide material.

De-lamination of pieces of PCD material from a drill in use may be a serious problem, since the piece is likely to be lodged deep in the hole being drilled and difficult to remove owing to the extremely high hardness of the PCD. This may result in loss of the part being manufactured, which may be relatively costly.

The occurrence of burrs in Ti and delamination defects in CFRP may be reduced by configuring the PCD cutting edge to have a positive or at least neutral cutting geometry, which would be expected to reduce the axial forces on the body (and on the PCD tip). On the other hand, a negative cutting geometry arrangement would be expected to result in a more stable cutting edge less prone to breakage, but the quality of the cut edge on the body would be expected to be worse.

While wishing not to be bound by a particular theory, the use of at least one intermediate layer comprising a sufficient content of diamond grains may result in improved distribution or reduction of stress between the superhard structure and the substrate. The inclusion of grains of the same superhard material as comprised in the superhard structure may have the aspect that the thermal and mechanical properties of the superhard structure and intermediate layer are better matched, resulting in a more gradual transition in properties between the superhard structure and the substrate. This aspect may be enhanced by the provision of more than one intermediate layer.

PCD structures comprising PCD material may be made by sintering together an aggregated plurality of diamond grains in the presence of a catalyst material for diamond, for example cobalt, at a pressure and temperature at which the diamond is thermodynamically more stable than graphite. The pressure may be at least about 5 GPa and the temperature may be at least about 1,250 degrees centigrade. In some versions, the pressure may be greater than 6.0 GPa, greater than 7.0 GPa or even least about 8 GPa. The diamond grains may be sintered on a cemented carbide substrate, resulting in a composite compact comprising a PCD structure bonded to the substrate. The substrate may contain a catalyst material such as cobalt and may provide a source of the catalyst material, which may infiltrate among the diamond grains when in the molten state at the pressure and temperature for sintering the PCD material. In one method of making a tip, a pre-composite assembly comprising a precursor sheet or sheets for the intermediate layer or layers interposed between an aggregated plurality of diamond grains and a cemented carbide substrate may be constructed. The precursor assembly may then be subjected to a pressure of at least about 5.5 GPa and a temperature of at least about 1,250 degrees centigrade to sinter the diamond grains and form a unitary body comprising PCD material joined to the substrate via at least one intermediate layer. The unitary body may then be processed by grinding, for example, to produce a blank body suitable for further processing to make a tip for a rotary machine tool. A PCD blank body may be processed by a method including electro-discharge machining (EDM) and grinding to form flutes and cutting faces of the tip.

In the example method described above, precursor sheets for intermediate layers may comprise diamond grains, carbide grains and metal powder held together by means of a binder material. An example method for making a layered PCD element includes providing tape cast sheets, each sheet comprising a plurality of diamond grains bonded together by a binder, such as a water-based organic binder, and stacking the sheets on top of one another and on top of a support body. Different sheets comprising diamond grains having different size distributions, diamond content and additives may be selectively stacked to achieve a desired structure. The sheets may be made by a method known in the art, such as extrusion or tape casting methods, wherein slurry comprising diamond grains and a binder material is laid onto a surface and allowed to dry. Other methods for making diamond-bearing sheets may also be used, such as described in U.S. Pat. Nos. 5,766,394 and 6,446,740 may be used. Alternative methods for depositing diamond-bearing layers include spraying methods, such as thermal spraying.

When sintering an aggregated mass of diamond grains together to form PCD material, solvent/catalyst material may be introduced to the aggregated mass in various ways. One way includes depositing metal oxide onto the surfaces of a plurality of diamond grains by means of precipitation from an aqueous solution prior to forming their consolidation into an aggregated mass. Such methods are disclosed in PCT publications numbers WO2006/032984 and also WO2007/110770. Another way includes preparing or providing metal alloy including a catalyst material for diamond in powder form and blending the powder with the plurality of diamond grains prior to their consolidation into an aggregated mass. The blending may be carried out by means of a ball mill. Other additives may be blended into the aggregated mass. The aggregated mass of diamond grains, including any solvent/catalyst material particles or additive material particles that may have been introduced, may be formed into an unbonded or loosely bonded structure, which may be placed onto a cemented carbide substrate. The cemented carbide substrate may contain a source of catalyst material for diamond, such as cobalt. The assembly comprising the aggregated mass of grains and the substrate may be encapsulated in a capsule suitable for an ultra-high pressure furnace apparatus and subjecting the capsule to a pressure of greater than 6 GPa. Various kinds of ultra-high pressure apparatus are known and can be used, including belt, torroidal, cubic and tetragonal multi-anvil systems. The temperature of the capsule should be high enough for the catalyst material to melt and low enough to avoid substantial conversion of diamond to graphite. The time should be long enough for sintering to be completed but as short as possible to maximise productivity and reduce costs.

The following clauses are offered as further descriptions of blank bodies, tips, rotary machine tools, method of using rotary machine tools and method of making tips.

1. A tip (also referred to herein as a superhard tip) for a rotary machine tool, comprising a superhard structure joined to a cemented carbide substrate by means of an intermediate layer disposed between the superhard structure and the cemented carbide substrate, the intermediate layer comprising grains of superhard material, such as diamond or cBN, and grains of a metal carbide material, such as tungsten carbide (WC) dispersed in a metal binder material, which may comprise cobalt (Co).
2. The tip of clause 1, comprising at least two flutes, a peripheral side of the superhard structure defining a cylindrical land connecting the flutes.
3. The tip of clause 1 or clause 2, for a twist drill or an end mill.
4. The tip of any of the preceding clauses, in which the superhard structure defines a chisel edge between cutting edges.
5. The tip of any of the preceding clauses, in which the superhard structure defines a flank surface.
6. The tip of any of the preceding clauses, in which the superhard structure comprises or consists of polycrystalline diamond (PCD) material.
7. The tip of any of the preceding clauses, in which the superhard structure comprises or consists of PCD material comprising at least about 85 volume percent or at least about 88 volume percent diamond.
8. The tip of any of the preceding clauses, in which the superhard structure comprises PCD material comprising at most about 10 volume percent metal catalyst material for diamond.
9. The tip of any of clauses 1 to 5, in which the superhard structure comprises or consists of PCBN material.
10. The tip of clause 9, in which the PCBN material comprises at least about 80 volume percent, or at least about 85 volume percent cBN grains dispersed in a binder matrix comprising Co, W and Al, and in which the cBN grains have mean size of at most about 5 microns or at most about 3 microns.
11. The tip of any of the preceding clauses, in which the superhard structure has a thickness (longitudinal thickness) of at least about 1 mm, at least about 2.5 mm or at least about 3 mm (at least at a cutting edge, for example).
12. The tip of any of the preceding clauses, in which the longitudinal thickness of the superhard structure is substantially not the same throughout the superhard structure.
13. The tip of any of the preceding clauses, in which the substrate has a proximate end and a distal end and the superhard structure, which may have the general form of a layer, covers substantially the entire proximate end, the distal end being attachable to a component, such as a drill shaft, for a rotary tool, such as a twist drill.
14. The tip of any of the preceding clauses, in which the superhard structure is joined to the cemented carbide substrate by means of at least two or at least three intermediate layers disposed between the superhard structure and the cemented carbide substrate, the intermediate layers comprising different relative contents of diamond grains, metal carbide grains and metal binder.
15. The tip of any of the preceding clauses, in which at least one intermediate layer has a thickness of at least about 0.1 mm.
16. The tip of any of the preceding clauses, in which at least one intermediate layer has a thickness of at most about 0.3 mm.
17. The tip of any of the preceding clauses, in which the intermediate layer comprises at least about 30 volume percent diamond and at most about 80 volume percent diamond grains, or at least about 10 volume percent cBN grains at most about 50 volume percent cBN grains.
18. A blank body for a tip (also referred to herein as a superhard tip) for a rotary machine tool, the blank body comprising a superhard structure joined to a cemented carbide substrate by means of an intermediate layer disposed between the superhard structure and the cemented carbide substrate, the intermediate layer comprising grains of superhard material, such as diamond or cBN, and grains of a metal carbide material, such as tungsten carbide (WC) dispersed in a metal binder material, which may comprise cobalt (Co).
19. The blank body of clause 18, in which the superhard structure comprises or consists of polycrystalline diamond (PCD) material.
20. The blank body of clause 18 or 19, in which the superhard structure comprises or consists of PCD material comprising at least about 85 volume percent diamond or at least about 88 volume percent diamond.
21. The blank body of any of clauses 18 to 20, in which the PCD material comprises at most about 10 volume percent metal catalyst material for diamond.
22. The blank body of any of clauses 18 to 21, in which the superhard structure comprises thermally stable PCD.
23. The blank body of clause 18, in which the superhard structure comprises or consists of PCBN material.
24. The blank body of clause 23, in which the PCBN material comprises at least about 80 volume percent, or at least about 85 volume percent cBN grains dispersed in a binder matrix comprising Co, W and Al, and in which the cBN grains have mean size of at most about 5 microns or at most about 3 microns.
25. The blank body of any of clauses 18 to 24, in which the substrate has a proximate end and a distal end and the superhard structure, which may have the general form of a layer, covers substantially the entire proximate end, the distal end being attachable to a component, such as a drill shaft, for a rotary tool, such as a twist drill.
26. The blank body of any of clauses 18 to 25, in which the superhard structure is joined to the cemented carbide substrate by means of at least two or at least three intermediate layers disposed between the superhard structure and the cemented carbide substrate, the intermediate layers comprising different compositions of diamond or cBN grains, metal carbide grains and metal binder.

27. The blank body of any of clauses 18 to 26, in which at least one intermediate layer has a thickness of at least about 0.1 mm.
28. The blank body of any of clauses 18 to 27, in which at least one intermediate layer has a thickness of at most about 0.3 mm.
29. The blank body of any clauses 18 to 28, in which the cemented carbide substrate has an elongate or generally cylindrical form having a proximate and a distal end, the proximate end being a working end and the distal end being an attachment end, a side surface connecting the proximate and distal ends; at least part of the working end having a substantially conical, frusto-conical shape or rounded conical shape, for example a spherically rounded conical shape, or a generally domed shape; the superhard structure being disposed adjacent the working end.
30. The blank body of any clauses 18 to 29, having an apex defined by the superhard structure and in which the longitudinal thickness of the superhard structure is greater adjacent a peripheral edge of the blank body than it is at the apex.
31. The blank body of any clauses 18 to 30, in which the superhard structure is in the general form of a cap.
32. The blank body of any of clauses 18 to 31, in which the combined thicknesses of the intermediate layers, or the thickness of the intermediate layer, as the case may be, is at least about 0.4 or at least about 0.6 mm.
33. The blank body of clause 18 or 32, in which the superhard structure has a thickness (longitudinal thickness) of at least about 1 mm, at least about 2.5 mm or at least about 3 mm (at least at a cutting edge, for example)
34. The blank body of any of clauses 18 to 33, comprising at least two or three intermediate layers, or a generally continuous gradation from cemented carbide material to the superhard structure.
35. A rotary machine tool comprising the superhard tip of any of clauses 1 to 17.
36. The rotary machine tool of clause 36, in which the superhard structure extends generally laterally from the longitudinal axis and defining a cutting edge.
37. A method of machining a body comprising titanium (Ti), carbon fibre-reinforced polymer (CFRP) material, or both Ti and CFRP, using the rotary machine tool of clause 35 or 36.
38. A method of making a tip for the rotary machine tool of clauses 35 or 36, the method including providing the blank body of any of clauses 18 to 34 and removing material from the blank body to form cutting edges.
39. The method of clause 38, including removing material from the blank body to form flutes.

Non-limiting examples are described in more detail below.

Example 1

A PCD tip blank body for a twist drill bit, comprising a multi-modal PCD cap bonded to a cemented carbide substrate via three intermediate layers was made.

A pre-compact assembly was prepared by providing a housing having an internal shape at one end configured with the same general shape as the intended shape of the working surface of the PCD tip blank body, and assembling precursor layers for the PCD structure and intermediate layers, as well as a substrate body into the housing.

The substrate body was formed cobalt cemented tungsten carbide, comprising about 10 weight percent cobalt and WC grains having a mean size in the range from about 4 microns to about 6 microns. The substrate body comprised a proximate end and a distal end, the ends connected by a generally cylindrical side surface. The proximate end had a spherically blunted conical shape with a rounded apex having a radius of curvature of about 2.25 mm.

Each of the three precursor layers for the three respective intermediate layers, designated L1, L2 and L3, was formed from a respective sheet, designated S1, S2 and S3, comprising three different compositions of diamond and tungsten carbide grains. One of the sheets, designated S1, also comprises admixed cobalt in powder form. The compositions of the layers S1, S2 and S2 in weight percent are shown in table 1 below, excluding the organic binder. The sheets were formed by means of tape casting respective slurries comprising the diamond and tungsten carbide grains and an organic binder, and allowing the cast slurries to dry. The diamond grains had a multi-modal size distribution and a mean size in the range from about 5 microns to about 15 microns. Blank body foils F1, F2 and F3 were cut from respective sheets S1, S2 and S3 to dimensions suitable for assembling into the housing, and forming each foil to comply with the internal shape of the end of the housing.

TABLE 1

| | Diamond | WC | Co |
|---|---|---|---|
| S1 | 75 wt. % | 25 wt. % | 0 wt. % |
| S2 | 50 wt. % | 50 wt. % | 0 wt. % |
| S3 | 20 wt. % | 61 wt. % | 19 wt. % |

The pre-compact assembly was assembled by placing a precursor layer for the PCD structure into the housing in contact with the shaped internal end of the housing, placing foil F1 against the PCD precursor layer, placing foil F2 against F1, placing a foil F3 against F2, and then placing the substrate body into the housing, pressing its proximate end against F3.

The pre-compact assembly was subjected to heat treatment in a vacuum to burn off substantially all of the organic binder and then assembled into a capsule for an ultra-high pressure furnace. The pre-compact assembly was subjected to a pressure of about 5.5 GPa and a temperature of about 1,350 degrees centigrade to sinter the PCD precursor structure to form a PCD end cap joined to the substrate body via three intermediate layers.

Example 2

A PCD tip blank body for a twist drill bit, comprising a multi-modal PCD cap bonded to a cemented carbide substrate via three intermediate layers was made similarly to that described in example 1, except that the content of Co in S3 was higher, as shown in table 2.

TABLE 2

| | Diamond | WC | Co |
|---|---|---|---|
| S1 | 75 wt. % | 25 wt. % | 0 wt. % |
| S2 | 50 wt. % | 50 wt. % | 0 wt. % |
| S3 | 18 wt. % | 54 wt. % | 28 wt. % |

Example 3

A PCBN tip blank body for a twist drill bit, comprising a PCBN structure in the general form of a layer bonded to a cemented carbide substrate via two intermediate layers was made. The blank body had a working end having a generally domed shape.

A pre-compact assembly was prepared by providing a housing having an internal shape at one end configured with the same general domed shape as the intended the working end of the blank body, and assembling precursor layers for the PCBN structure and intermediate layers, as well as a substrate body into the housing.

The substrate body consisted essentially of formed cobalt cemented tungsten carbide, comprising about 8 weight percent cobalt and WC grains having a mean size in the range from about 4 microns to about 6 microns.

Each of the two precursor layers for the two respective intermediate layers L1 and L2 was formed from a respective sheet S1 and S2, comprising three different respective compositions of cBN and tungsten carbide grains, held together by means of an organic binder material. The compositions of the layers S1 and S2 in weight percent are shown in table 3 below, excluding the organic binder material. The sheets were formed by means of tape casting respective slurries comprising the cBN and tungsten carbide grains and the organic binder material, and allowing the cast slurries to dry. Foils F1 and F2 were cut from respective sheets S1 and S2, to dimensions suitable for assembling into the housing.

TABLE 3

| | cBN | WC | Co |
|---|---|---|---|
| S1 | 50 wt. % | 50 wt. % | 0 wt. % |
| S2 | 25 wt. % | 75 wt. % | 0 wt. % |

The pre-compact assembly was assembled by placing precursor material for the PCBN structure into the housing in contact with the shaped internal end of the housing, placing foil F1 against the PCBN precursor layer, and placing foil F2 against F1, and then placing the substrate body into the housing, pressing its proximate end against F2. The precursor material for the PCBN structure comprised a blend of cBN grains with Al powder, W powder and WC powder.

The pre-compact assembly was subjected to heat treatment in a vacuum to burn off substantially all of the organic binder and then assembled into a capsule for an ultra-high pressure furnace. The pre-compact assembly was subjected to a pressure of about 5 GPa and a temperature of about 1,400 degrees centigrade to sinter the PCBN precursor structure to form a PCBN end cap joined to the substrate body via two intermediate layers. The sintered PCBN structure comprised 85 volume percent cBN grains having a mean size of about 2 microns, dispersed within a binder matrix material comprising Co, W and Al.

Various example embodiments of superhard tips, blank bodies for tips and tools have been described above. Those skilled in the art will understand that changes and modifications may be made to those examples without departing from the spirit and scope of the claimed invention.

The invention claimed is:

1. A tip for a twist drill or an end mill, the tip comprising a superhard structure joined to a cemented carbide substrate by at least two intermediate layers disposed between the superhard structure and the cemented carbide substrate, the intermediate layers comprising grains of superhard material and grains of a metal carbide material dispersed in a metal binder material, each intermediate layer comprising different compositions of diamond grains, metal carbide grains, and metal binder, the superhard structure comprising any of a polycrystalline diamond (PCD) material and a polycrystalline boron nitride (PCBN) material, the superhard structure having a thickness of greater than 1 mm, the tip comprising at least two flutes, a peripheral side of the superhard structure defining a cylindrical land connecting the flutes.

2. A tip as claimed in claim 1, in which the superhard structure comprises PCD material.

3. A tip as claimed in claim 1, in which the superhard structure comprises PCD material and the intermediate layers comprise at least 30 volume percent diamond grains and at most 80 volume percent diamond grains.

4. A tip as claimed in claim 1, in which the superhard structure comprises PCBN material and the intermediate layers comprise at least 10 volume percent cBN grains and at most 50 volume percent cBN grains.

5. A tip as claimed in claim 1, in which the superhard structure comprises PCD material and at least one intermediate layer has a thickness of at least 0.1 mm.

6. A tip as claimed in claim 1, in which the superhard structure comprises PCBN material comprising at least 80 volume percent cBN grains dispersed in a binder matrix comprising Co, W and Al, and in which the cBN grains have mean size of at most 5 microns.

7. A tip as claimed in claim 1, in which the superhard structure comprises PCD material comprising at most 10 volume percent metal catalyst material for diamond.

8. A rotary machine tool comprising a tip as claimed in claim 1.

9. A method of making a tip as claimed in claim 1, the method including providing a blank body comprising a superhard structure joined to a cemented carbide substrate by at least two intermediate layers disposed between the superhard structure and the cemented carbide substrate, each intermediate layer comprising grains of superhard material and grains of a metal carbide material, the intermediate layers comprising different compositions of diamond grains, metal carbide grains and metal binder; and removing material from the blank body to form cutting edges, wherein the superhard structure comprises a material selected from any of polycrystalline diamond (PCD) and polycrystalline cubic boron nitride (PCBN), the method further comprising removing material from the blank body to form at least two flutes such that a peripheral side of the superhard structure defines a cylindrical land connecting the flutes.

10. A tip for a twist drill or an end mill, the tip comprising a superhard structure joined to a cemented carbide substrate by at least two intermediate layers disposed between the superhard structure and the cemented carbide substrate, the intermediate layers comprising grains of superhard material and grains of a metal carbide material dispersed in a metal binder material comprising cobalt (Co), each intermediate layer comprising different compositions of diamond grains, metal carbide grains, and metal binder; the tip comprising at least two flutes, a peripheral side of the superhard structure defining a cylindrical land connecting the flutes, the superhard structure comprises a material selected from any of polycrystalline diamond (PCD) and polycrystalline cubic boron nitride (PCBN) and has a thickness greater than 1 mm.

11. A tip as claimed in claim 10, in which the superhard structure defines a chisel edge between cutting edges.

12. A tip as claimed in claim 10, in which the superhard structure comprises PCD material comprising at least 85 volume percent diamond.

13. A tip as claimed in claim 10, in which the superhard structure comprises PCBN material comprising at least 80 volume percent cBN grains dispersed in a binder matrix comprising Co, W and Al, and in which the cBN grains have mean size of at most 5 microns.

14. A tip as claimed in claim 10, in which the substrate has a proximate end and a distal end and the superhard structure covers substantially the entire proximate end, the distal end being attachable to a component for a rotary tool.

15. A method of machining a body comprising carbon fibre-reinforced polymer (CFRP) material using a twist drill or an end mill comprising a tip, the tip comprising a superhard structure joined to a cemented carbide substrate by at least two intermediate layers disposed between the superhard structure and the cemented carbide substrate, each intermediate layer comprising grains of superhard material and grains of a metal carbide material dispersed in a metal binder material, the intermediate layers comprising different compositions of diamond grains, metal carbide grains, and metal binder, wherein the superhard structure comprises a material selected from any of polycrystalline diamond (PCD) and polycrystalline cubic boron nitride (PCBN) and has a thickness greater than 1 mm, the method further comprising removing material from the blank body to form at least two flutes such that a peripheral side of the superhard structure defines a cylindrical land connecting the flutes.

16. A method as claimed in claim 15, in which the body comprises titanium (Ti) and carbon fibre-reinforced polymer (CFRP) material.

* * * * *